US011304458B2

(12) United States Patent
Karon

(10) Patent No.: US 11,304,458 B2
(45) Date of Patent: Apr. 19, 2022

(54) REVERSIBLY WEARABLE WINGED BRA

(71) Applicant: COCONUT GROVE PADS, INC., Markham (CA)

(72) Inventor: Hylton Karon, Markham (CA)

( * ) Notice: Subject to any disclaimer, the term of this patent is extended or adjusted under 35 U.S.C. 154(b) by 149 days.

(21) Appl. No.: 16/922,359

(22) Filed: Jul. 7, 2020

(65) Prior Publication Data

US 2022/0007747 A1 Jan. 13, 2022

(51) Int. Cl.
*A41C 3/06* (2006.01)
*A41C 3/12* (2006.01)

(52) U.S. Cl.
CPC ..... *A41C 3/065* (2013.01); *A41C 3/12* (2013.01)

(58) Field of Classification Search
CPC ..... A41C 3/12; A41C 3/065
USPC ..... 450/81, 88
See application file for complete search history.

(56) References Cited

U.S. PATENT DOCUMENTS 6,231,424 B1 * 5/2001 Valentin ..... A41C 3/065 450/88
7,335,086 B1 * 2/2008 Karon ..... A41C 3/065 450/86
2005/0260921 A1 * 11/2005 Silver ..... A41C 3/065 450/81
2006/0228989 A1 * 10/2006 Chou ..... A41C 3/065 450/81
2009/0093190 A1 * 4/2009 Wooley ..... A41C 3/065 450/41
2011/0171880 A1 * 7/2011 Nam ..... A41C 3/065 450/92
2013/0095729 A1 * 4/2013 Chang ..... A41C 3/065 450/81
2014/0057528 A1 * 2/2014 Deal ..... A41C 3/0078 450/38
2014/0342638 A1 * 11/2014 Chen ..... A41C 3/065 450/81
2015/0313291 A1 * 11/2015 Jackson ..... A41C 3/0078 450/88
2022/0007747 A1 * 1/2022 Karon ..... A41C 3/12

* cited by examiner

*Primary Examiner* — Gloria M Hale

(57) ABSTRACT

The present invention provides a winged bra that can be worn reversibly. The winged bra includes a pair of cups attached together from one end. An adhesive wing is fixed at the other end of each cup wherein adhesive is applied to both sides of the wing. The winged bra is strapless and reversibly wearable by the user by peeling off a protective layer from either side of the adhesive wing to be attached to the torso of the user, and attaching the bra to the torso.

14 Claims, 7 Drawing Sheets

REVERSIBLY WEARABLE WINGED BRA

FIELD OF INVENTION

The present invention relates to a strapless winged bra. More specifically, the present invention provides a reversibly wearable strapless winged bra with dual-sided adhesive wings.

BACKGROUND OF THE INVENTION

A conventional winged bra includes adhesive material on one side of the wings only and the bra is not reversible. The adhesive material is used for attaching the winged bra to the user's torso. This in turn provides support to the user's breasts. One such winged bra is disclosed in Korean Patent KR20130000536 assigned to Seungho Kim. However, this patent fails to provide sufficient support to user's breast and makes it uneasy for the user wearing the winged bra after a certain time.

Another bra is disclosed in U.S. Pat. No. 7,677,952, assigned to Susan Wooley, and relates to a supportive and washable adhesive bra with detachable support structures. The winged bra provides an extended adhesive support on the wings along with the cups. However, such a device is not reversible and does not teach adding adhesive to both the front and back portions of the wing member.

Another bra is shown in US Patent Application US20130217304, assigned to Theresa Bailey, discloses a reversible bra with a closure in the front between a pair of cups allowing the user to fasten the bra easily in front. The reversible bra described in this patent application is supported by straps on the shoulders and in one embodiment the reversible bra describes being strapless, but not as the result of any dual-sided adhesive wings.

Hence, there is need for a backless and strapless winged bra that is wearable from both sides. The improved reversibly wearable winged bra should not only provide additional support to the user's breasts but also support the breasts for a longer period of time. Specifically, the additional support should be directed towards lifting the cups of the reversibly wearable winged bra and providing stability to the cups of the bra in a particular position. This is achieved through the novel dual-sided adhesive wings.

It is apparent now that numerous winged bras have been developed in the prior art that are adequate for various purposes. Furthermore, even though these inventions may be suitable for the specific purposes to which they address, accordingly, they would not be suitable for the purposes of the present invention as described herein. Thus, there is a need for an improved winged bra that is strapless and reversibly wearable with support coming from dual-sided adhesive wings.

SUMMARY OF THE INVENTION

The present invention provides an improved version of a winged bra that can be worn reversibly. The reversibly wearable winged bra includes a pair of cups, and a pair of wings which provides supplementary support. The reversibly wearable winged bra includes two protective layers wherein each of layers varies in color to correspond with the color of each side of the cups. Each side of the cups has a first fabric layer disposed on an outer surface and a second fabric layer disposed on an inner surface of the cups. More specifically, the color of the first fabric layer disposed on the outer surface and the second fabric layer disposed on the inner surface is different.

The reversibly wearable winged bra further includes a pair of wings which provides support and stability to the breasts of the user wearing the bra. The wings are attached to respective ends of the each cup. The reversibly wearable winged bra further includes an adhesive layer applied on both sides of the wings, to secure the pair of cups and improve its adjustability to the breasts. The protective layers aforementioned are detachably attached to the adhesive layers applied on both sides of the wings for retaining the bra's ability to adhere, so as to provide additional support to bra use for longer durations.

In one embodiment of the present invention, the material and/or color of the protective layer attached on the adhesive layer disposed on the front side and back side of the wings is the same as that of the material and/or color of fabric attached on the outer surface and inner surface of the pair of cups of the winged bra respectively. The shape of the protective layer is same as or similar to the shape of the wings of the reversibly wearable winged bra. Depending on which side the wearer chooses, the protective layer on the back side of the wings is removed exposing the adhesive for adhering the bra to the wearer. The protective layer on the front side matches at least in color to the outer surface of the cups, resulting in a uniform looking cup-wing combination or assembly. The reversibly wearable winged bra can also include a conventional underwire or underwires for securing the cups at a position comfortable to the wearer.

In alternative embodiment, the present invention provides a reversibly wearable, backless and strapless winged bra. The bra includes a pair of cups, which includes two fabrics and each of fabrics varies in color. Each side of the cup has a first fabric layer disposed on an outer surface and a second fabric layer disposed on an inner surface of the cups. More specifically, the color and/or pattern of the first fabric layer and the second fabric layer is different The reversibly wearable winged bra further includes a pair of wings attached to respective ends of the each cup, with adhesive disposed on both sides of the wings to secure the pair of cups and improve the bra's adjustability to the breasts. The reversibly wearable winged bra further includes a protective layer, which is detachably attached to the adhesive layer applied on both sides of the wings for retaining the bra's ability to adhere, so as to provide additional support to the bra use for longer durations.

A primary objective of the present invention therefore is to provide a backless and strapless winged bra that can be worn reversibly, thus reducing the cost a wearer spends on expensive lingerie and also reducing the amount of space used to store the same.

Another objective of the present invention is to provide a reversible, backless and strapless winged bra that can be worn to compliment multiple outfits in this fashionable era.

Another objective of the present invention is to provide a reversible winged bra that comprises fabrics or pattern designs of different colors enabling a wearer to choose between two colors to wear.

Yet another objective of the present invention is to provide a reversible winged bra that provides two design options in a single bra to the wearer, such that protective layers that are detachably removable from the wings are color-coordinated with the outer surface and inner surface of the bra cups.

Still yet another objective of the present invention is to provide additional stability to the reversible wearable winged bra by providing a supplementary support to the cups through an adhesive means configured at both sides of the wings. The adhesive means secures the cups at specific positions and provides stability to the breasts of the user wearing the winged bra. The adhesive means comprises a layer of silicon adhesive applied on each side of the wings. The adhesive layer can be made of a medical grade, thus providing protection to the human skin from allergies and skin infection.

It is thus yet another object of the present invention to provide for a reversible winged bra that offers double the adhesive capability of a strapless, backless winged bra given that both sides of the wings can be affixed to the torso of a user.

Embodiments of the present invention may employ any or all of the exemplary aspects above. Those skilled in the art will further appreciate the above-noted features and advantages of the invention together with other important aspects thereof upon reading the detailed description that follows in conjunction with the drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE DRAWINGS

The invention relates to an improved winged bra that can be worn reversibly. The reversibly wearable winged bra includes a pair of cups and a wing member attached to the distal sides of each cup. Specifically, the winged bra of the present invention includes an adhesive disposed on each side of the wings. The adhesive disposed on the wings provides an additional support to the breasts of a user.

Figure 1A:
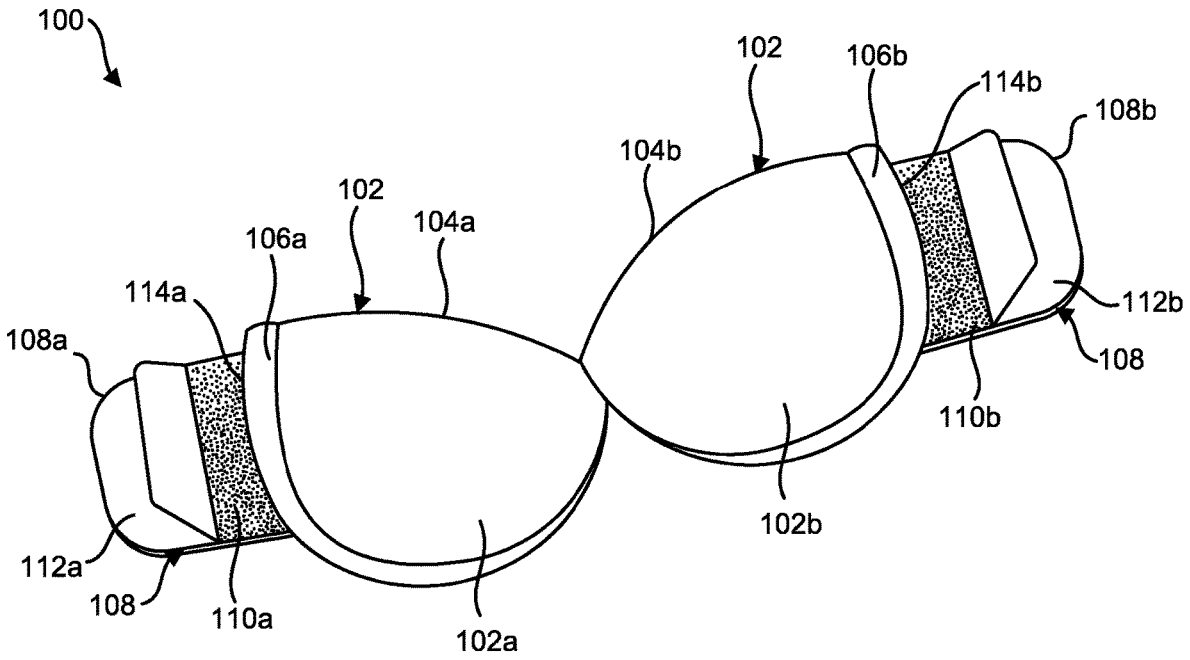
FIG. 1(A) illustrates a front perspective view of a reversible wearable winged bra.

FIG. 1(A) illustrates a front perspective view of an improved winged bra (100) that can be reversibly worn. The winged bra (100) includes a pair of cups (102) where one cup (102*a*) consists of two ends having a proximal end (104*a*) and a distal end (106*a*). Similarly the other cup (102*b*) includes two ends comprising a proximal end (104*b*) and a distal end (106*b*). The pair of cups (102*a*, 102*b*) is connected to each other where the proximal end (104*a*) of one cup (102*a*) is connected with the proximal end (104*b*) of the other cup (102*b*).

The pair of cups (102*a*, 102*b*) further includes an outer surface, wherein the wearer may wear the winged bra (100) with the outer surface showing. The outer surface of pair of cups (102*a*, 102*b*) is made of a first fabric layer. The material of the first fabric layer is either of cotton, silk, synthetic, lace, lycra, satin or the like. The color of the first fabric layer is black, grey, white, pink, violet, green, brown, beige, fawn, blue, purple or any other color, or pattern or design.

The winged bra (100) further includes a pair of wings (108) where one wing (108*a*) is connected to the distal end (106*a*) of the cup (102*a*). Similarly, the other wing (108*b*) is connected to the distal end (106*b*) of the cup (102*b*). In a preferred embodiment, the attachment of the wings (108) to the cups (102*a*, 102*b*) can be achieved by techniques like heat pressing, sewing, sticking with a means of adherent or the like.

The pair of wings (108*a*, 108*b*) includes two sides, a front side and a back side. An adhesive layer (110*a*, 110*b*) is disposed on the front side of each of the pair of wings (108*a*, 108*b*). The adhesive layer (110*a*, 110*b*) is reusable and typically a silicone based adhesive, preferably a medical grade, so no harm can be caused to the skin of the wearer. The adhesive (110*a*, 110*b*) may be either in the form of coating, strips or the like. The adhesive layers (110*a*, 110*b*) also include protective layers (112*a*, 112*b*) disposed on the front side of the wings (108*a*, 108*b*).

In one embodiment of the present invention, the material of the protective layers (112*a*, 112*b*) attached on the adhesive member (110*a*, 110*b*) disposed on the front side of the wings (108*a*, 108*b*) is the same as or similar to that of material of fabric attached on the outer surface of the pair of cups (102*a*, 102*b*) of the winged bra (100). In another embodiment of the present invention, the color or pattern of the protective layers (112*a*, 112*b*) attached on the adhesive members (110*a*, 110*b*) disposed on the front side of the wings (108*a*, 108*b*) is the same as or similar to that of the color or pattern of the material of fabric attached on the outer surface of the pair of cups (102*a*, 102*b*) of the winged bra (100). For example, when the material of the fabric attached on the outer surface of the pair of cups (102*a*, 102*b*) is cotton and has a beige color, the material and color of the protective layer (112*a*, 112*b*) is a beige cotton. As another example, when the outer surface of the pair of cups (102*a*, 102*b*) is made of fabric material that is a beige colored cotton, the protective layer (112*a*, 112*b*) is also beige, whether or not it is made of cotton. These examples illustrate the maintenance of uniformity of color of the outward appearance of the pair of cups (102*a*, 102*b*) and protective layers (112*a*, 112*b*) of the winged bra (100) when the bra is in use, or stored. The shape of the protective layers (112*a*, 112*b*) is the same as or similar to that of the shape of the pair of wings (108*a*, 108*b*) of the winged bra (100).

As hereinabove described, and more specifically, the pair of wings (108*a*, 108*b*) includes two front sides. Where one wing (108*a*) includes a first front side (114*a*) and the other wing (108*b*) includes a second front side (114*b*) onto which adhesive members or layers (110*a*, 110*b*) are disposed, respectively. Both the wings (108*a*, 108*b*) are substantially identical. Furthermore, and as discussed in more detail below and shown in FIG. 1(B), the pair of wings comprise second rear or back sides (108*c*, 108*d*). In the drawing of FIG. 1(A), the wings (108) are attached to the user's torso on the second rear sides (108*c*, 108*d*), and thus, in this embodiment, the protective layers (shown in FIG. 1(B) as 112*c*, 112*d*) are removed to expose the adhesive layers for adhering to the wearer. The protective layers (112*a*, 112*b*) on the first front sides (114*a*, 114*b*) remain on the adhesive members (110*a*, 110*b*) to provide for color and/or fabric coordination with the outer surface of the pair of cups (102*a*, 102*b*).

Figure 1B:
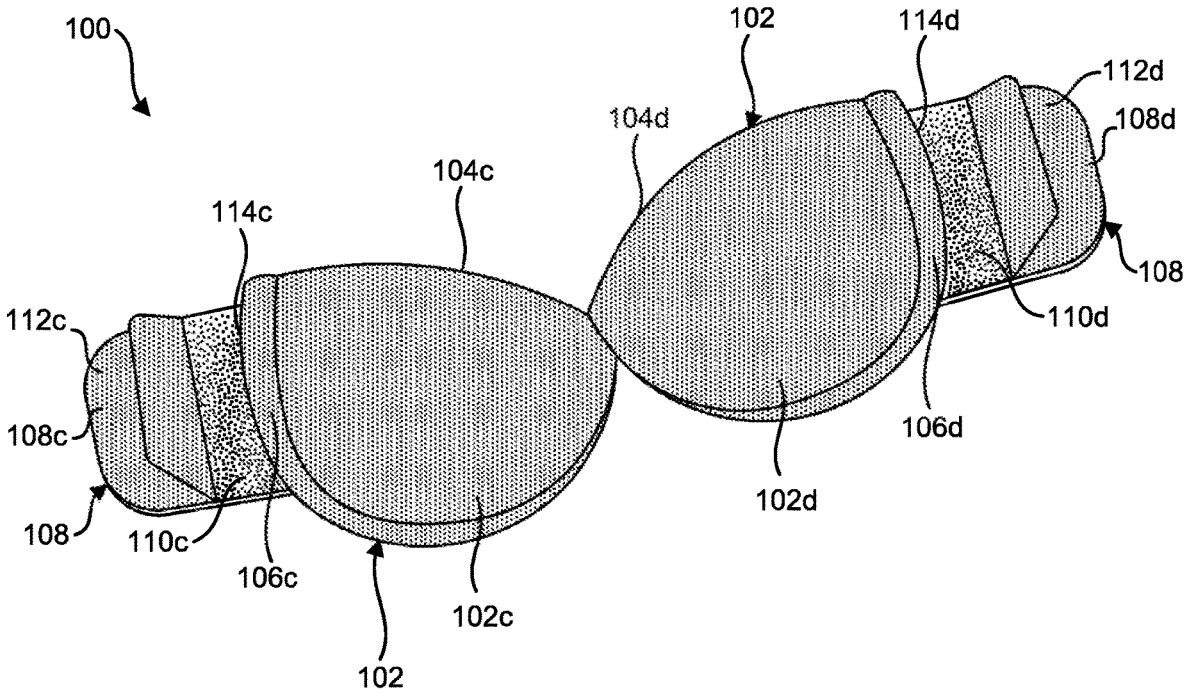
FIG. 1(B) illustrates a back perspective view of the reversible wearable winged bra.

FIG. 1(B) illustrates a back perspective view of an improved winged bra (100) that can be reversibly worn. The winged bra (100) includes a pair of cups (102) where one cup (102*c*) consists of two ends—a proximal end (104*c*) and a distal end (106*c*). Similarly the other cup (102*d*) includes two ends, specifically, a proximal end (104*d*) and a distal end (106*d*). The pair of cups (102*c*, 102*d*) is connected to each other where the proximal end (104*c*) of one cup 102*c* is connected with the proximal end (104*d*) of the other cup (102*d*).

The pair of cups (102*c*, 102*d*) further includes an inner surface, wherein the wearer may wear the winged bra (100) with the outer surface showing as seen in FIG. 1(A). The inner surface of pair of cups (102*c*, 102*d*) is made of second fabric layer. The material of the second fabric layer is either of cotton, silk, lace, synthetic, lycra, satin or like. The color of the second fabric layer is black, grey, white, pink, violet, green, brown, beige, fawn, blue, purple, or any other color, pattern or design. Preferably, the color of the first fabric layer and the second fabric layer is different.

The winged bra (100) further includes a pair of wings (108) where one wing (108*c*) is connected to the distal end (106*c*) of the cup (102*c*). Similarly, the other wing (108*d*) is connected to the distal end (106*d*) of the cup (102*d*). Moreover, the pair of wings (108*c*, 108*d*) includes two sides, a front side and a back side.

Furthermore, both front side and back side of the pair of wings (108) are capable of being adhered to the user's skin. An adhesive layer (110*c*, 110*d*) is disposed on the back side of each of the pair of wings (108*c*, 108*d*). The adhesive layer (110*c*, 110*d*) is reusable and typically medical grade silicone adhesive, so no harm can be caused to the skin of the wearer. The adhesive (110*c*, 110*d*) may be either in the form of a coating, strips or like. The adhesive members (110*c*, 110*d*) also include protective layers (112*c*, 112*d*) disposed on the back side of the wings (108*c*, 108*d*). This pair of protective layers (112*c*, 112*d*) can be peeled off when the winged bra 100 is in use and can again be pasted back on when not in use. The pair of protective layers (112*c*, 112*d*) aids to keep the bra adhesive lint free when stored. Moreover, the material and/or color of the protective layer (112*c*, 112*d*) attached to the adhesive member (110*c*, 110*d*) disposed on the back side of the wings (108*c*, 108*d*) is the same as that of material and/or color of the fabric used on the inner surface of the pair of cups (102*c*, 102*d*).

It should be appreciated, and understood, that while it has been described herein that FIG. 1(A) represents as an example the outer surface in a first color, and FIG. 1(B) represents as an example the inner surface of the bra (100) in a second color, because the bra (100) is reversible, the inner and outer surfaces can be reversed. Accordingly, when the bra (100) is worn in reverse, the outer surface would be the second color, and the inner surface would be the first color. The protective layers (112*a*, 112*b*) and (112*c*, 112*d*), would be peeled away exposing adhesive members according to which surface the wearer of the bra (100) chooses as the outer surface. Always, though, it is intended that the protective layers for the inner surface would be removed prior to adhering the bra (100) onto the user, and the protective layers on the outer surface would remain intact on the wings (108) in order to color coordinate them with the fabric and/or color of the exposed bra cups (102*a*, 102*b*) or (102*c*, 102*d*), respectively.

Figure 2A:
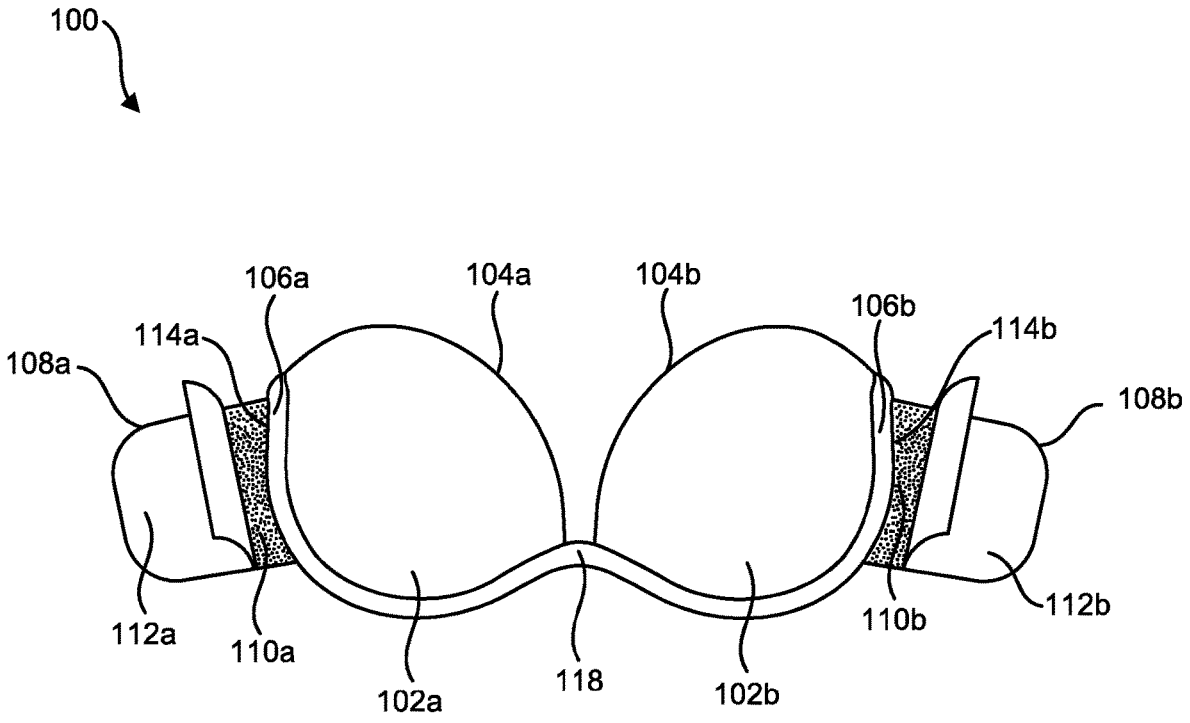
FIG. 2(A) illustrates a front view of the reversible wearable winged bra.

FIG. 2(A) illustrates a front view of an improved winged bra (100). The front view of the winged bra (100) includes a pair of cups (102) where one cup (102*a*) consists of two ends—a proximal end (104*a*) and a distal end (106*a*). Similarly, the other cup (102*b*) includes two ends—a proximal end (104*b*) and a distal end (106*b*). The pair of cups (102*a*, 102*b*) is connected to each other where the proximal end (104*a*) of one cup (102*a*) is connected with the proximal end (104*b*) of the other cup (102*b*).

Figure 2B:
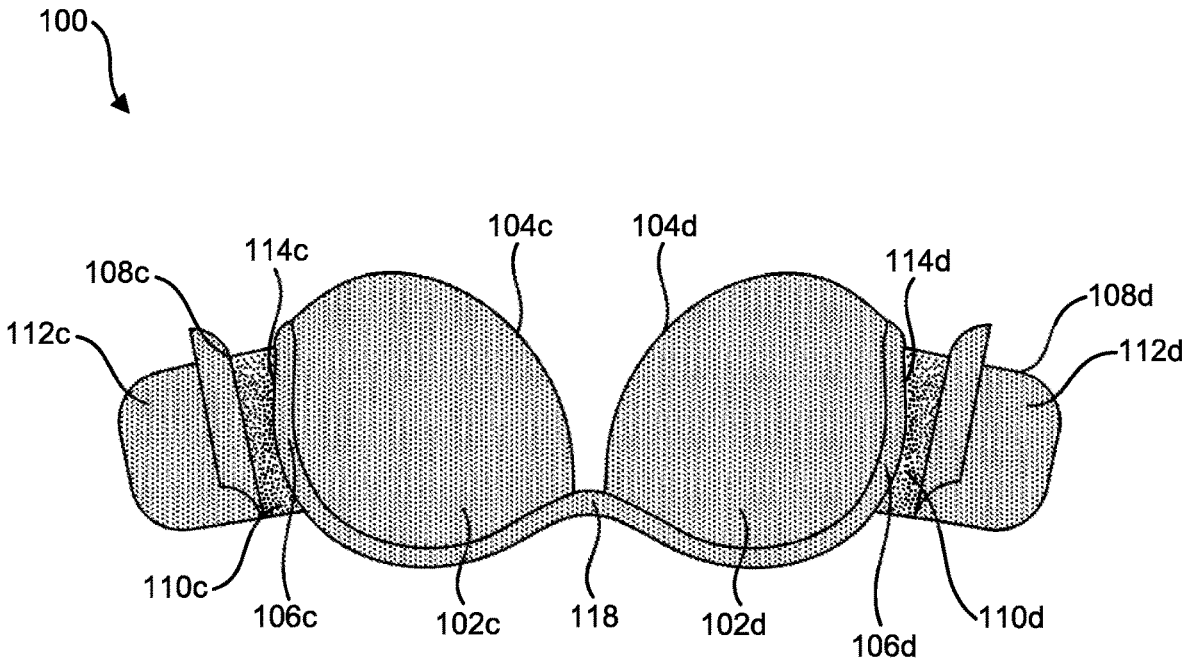
FIG. 2(B) illustrates a back view of the reversible wearable winged bra.

In one embodiment, the proximal ends (104*a*, 104*b*) of cups (102*a*, 102*b*) are connected with an strip of fabric (118). In another other embodiment, the proximal ends (104*a*, 104*b*) of cups (102*a*, 102*b*) can be connected with a hook type connection (not shown) with a hook present on one cup (102*a*) and a receiving end present on the other cup (102*b*). The cups (102*a*, 102*b*) aforementioned can be padded or a non-padded. In this FIG. 2(A), the embodiment shows a connection of the proximal ends (104*a*, 104*b*) of the cups (102*a*, 102*b*) by means of a fabric strip (118) and with no underwire. In FIG. 2(B), the reverse side of the bra (100) is shown relative to the side shown in FIG. 2(A).

Figure 3A:
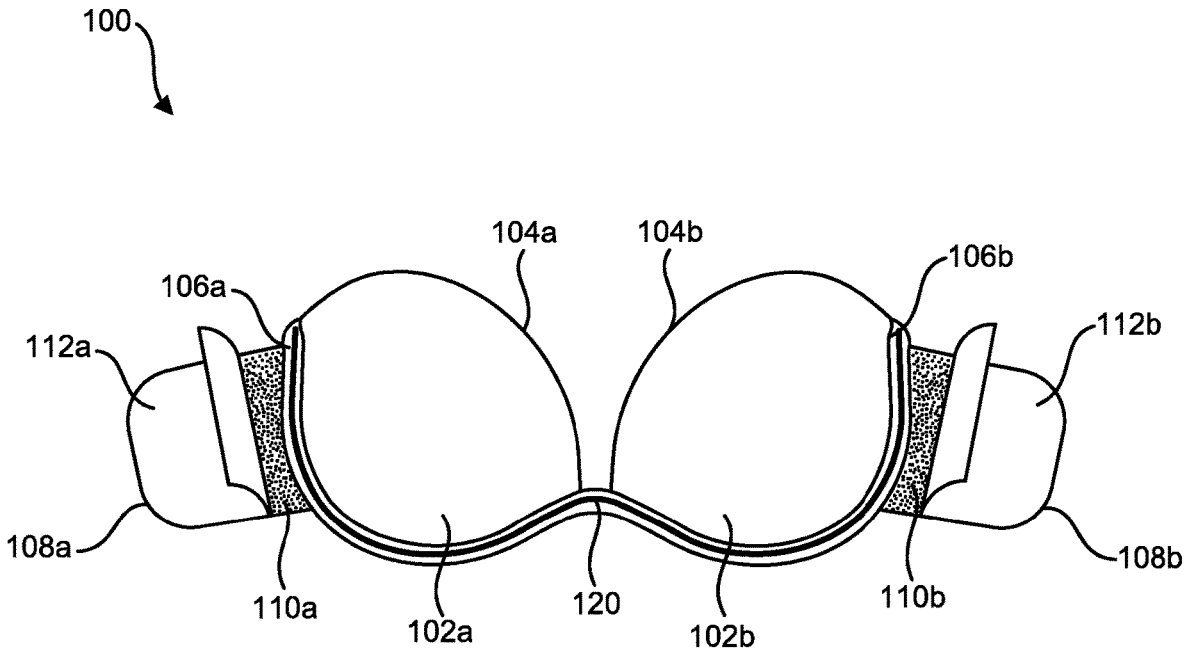
FIG. 3(A) illustrates a front view of the reversible wearable winged bra with an underwire and an adhesive member disposed on front side of the pair of wings.
Figure 3B:
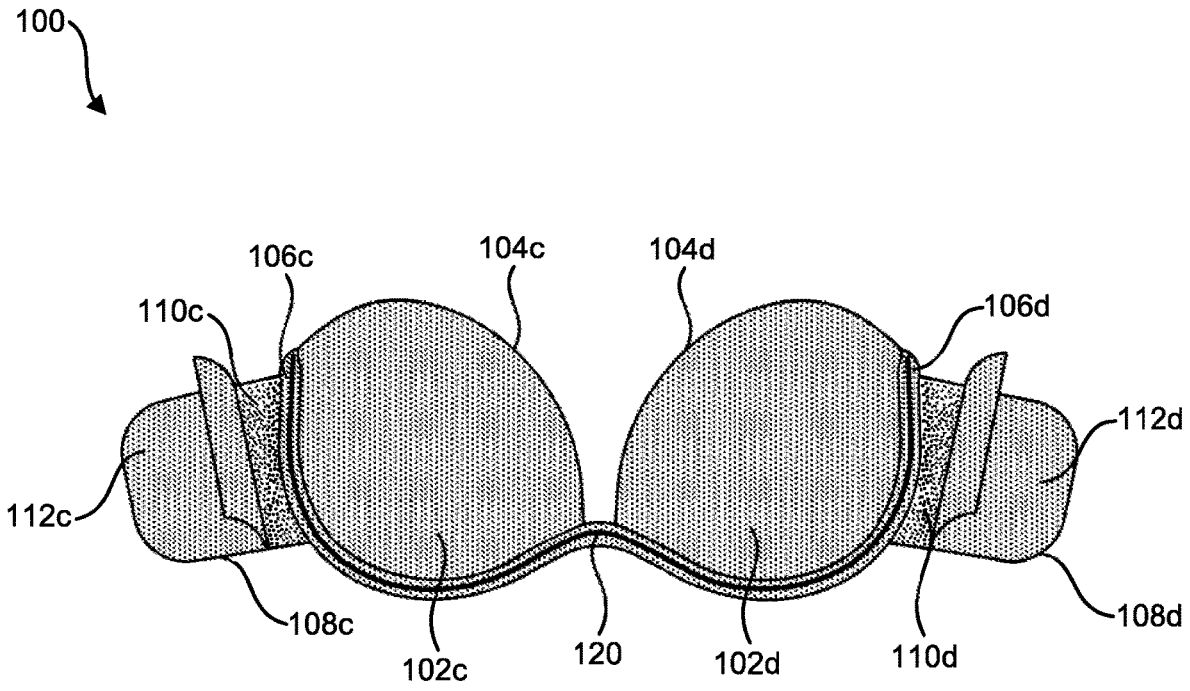
FIG. 3(B) illustrates a back view of the reversible wearable winged bra with the underwire and an adhesive member disposed on back side of the pair of wings.

In FIG. 3(A), in still yet another embodiment, the bra (100) shown is the same as that shown in FIG. 2(A), except with a single underwire (120). The underwire (120) is secured within the periphery of the pair of cups (102*a*, 102*b*) and enhances breast support. Additionally, the underwire (120) lies between the pair of cups (102*a*, 102*b*) and the pair of wings (108*a*, 108*b*). The underwire (120) can be made of any conventional material including a metal wire preferably copper, steel, aluminum or other alloy; or a suitable plastic. In one embodiment of the present invention, the underwire (120) is stitched in place within the fabric of the reversibly wearable winged bra (100). FIG. 3(B) represents the bra (100) in the reverse format of that shown in FIG. 3(A). While one single underwire (120) is shown in this embodiment, separate underwires formed under each cup (102) is optional.

As with the preferred embodiment shown in FIGS. 1(A, B), the reversible bra (100) structure is equally applicable to the other embodiments depicted in FIGS. 2(A, B) and 3(A, B). Specifically, depending upon the discretion of the user, the respective protective layers (112*c*, 112*d*) of the adhesive members (110*c*, 110*d*) for the back side of the wings (108), (the sides to be adjacent the skin of the user), are peeled away to expose the adhesive for attaching the bra (100) to the wearer. The opposite front sides of the wings (108) will still retain the protective layers (112*a*, 112*b*) to ensure a continuous color coordinated cup-wing assembly, and also to prevent exposure of the adhesive members to the elements in order to keep those members lint free and to prevent them from adhering to an outer garment such as a shirt or blouse.

Figure 4:
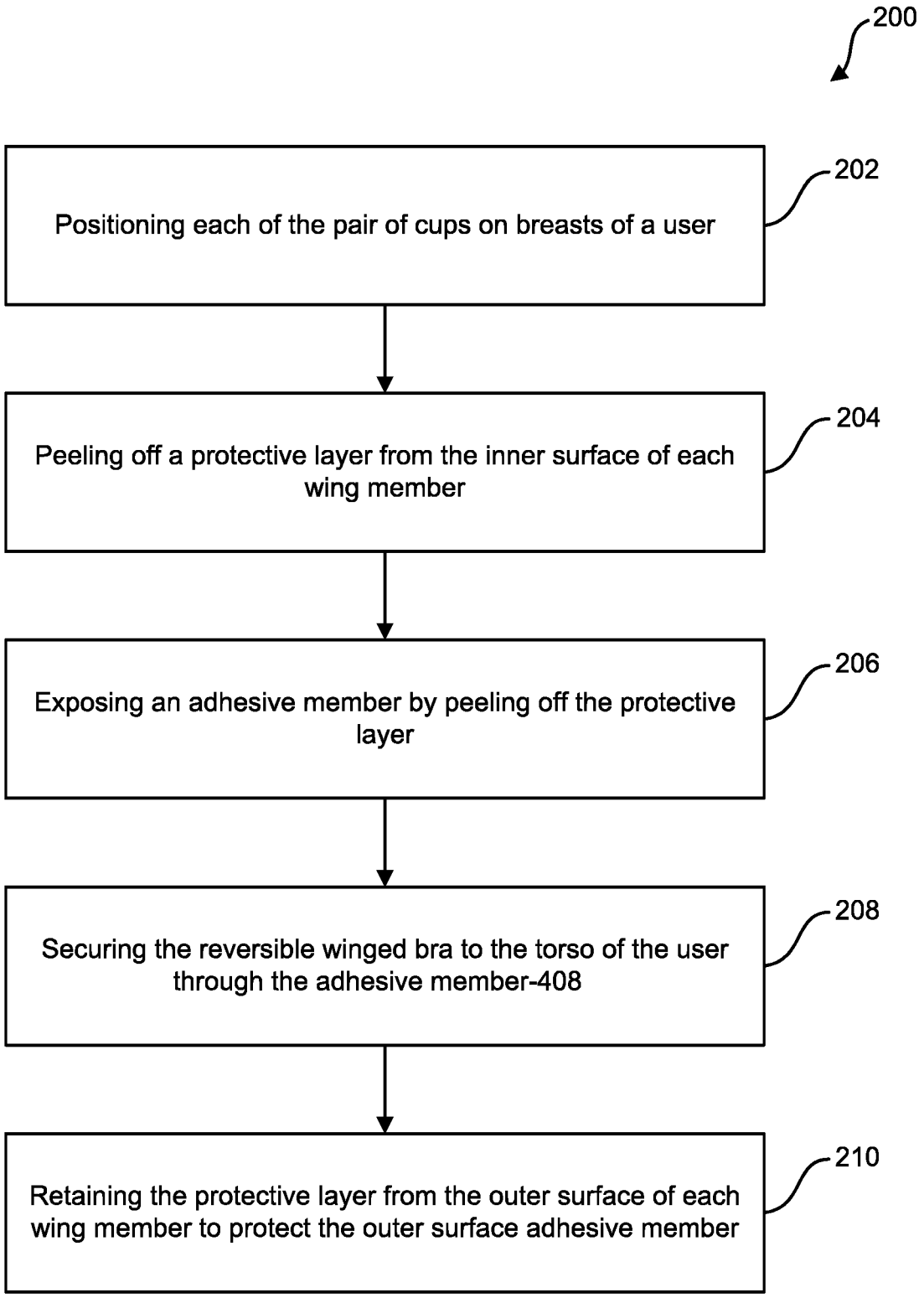
FIG. 4 illustrates a flow chart showing a method of wearing the reversible wearable winged bra.

FIG. 4 illustrates a novel method for wearing a reversible winged bra. The reversible winged bra has a pair of cups and a wing member at distal ends of each cup. Step 202 mentions positioning the pair of cups on the breast of the user. Each cup of a first color is placed on one side of a user's breast while a second color on the pair of cups is visible from the other side in front of the user. Thereafter, step 204 discloses the user peeling off a protective layer (112*c*, 112*d*) of a second color from each of the wing members 108. This results in step 206, which includes exposing an adhesive member of the wing members 108. A next step 208 allows securing the reversible winged bra to the torso of the user by the adhesive member. A final step 210 provides the wearer to retain the protective layers (112*a*, 112*b*) on the outer surface of the wing members 108 to color/fabric coordinate them with the outer surface of the pair of cups (102).

Although the invention is described above in terms of various exemplary embodiments and implementations, it should be understood that the various features, aspects and functionality described in one or more of the individual embodiments are not limited in their applicability to the particular embodiment in which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

The invention claimed is:

1. A backless and strapless winged bra, the backless and strapless winged bra comprising:

a) a pair of cups comprising a material with proximal and distal ends;

b) a pair of wings with a front surface and a back surface, wherein a first wing is attached to the distal end of a first cup and a second wing is attached to the distal end of the second cup;

c) an adhesive layer disposed on the front surface and the back surface of each wing for adhering the said wings to a torso of a wearer; and, d) a protective layer comprising a material that is placed on the adhesive layer of each wing, wherein the protective layer is detachable from the adhesive layer.

2. The backless and strapless winged bra according to claim 1, wherein the winged bra is reversibly wearable.

3. The backless and strapless winged bra according to claim 1, wherein the pair of cups comprise an outer surface material comprising a first fabric layer and an inner surface material comprising a second fabric layer.

4. The backless and strapless winged bra according to claim 3, wherein the first fabric layer comprises a first color and the second fabric layer comprises a second color such that the first and second colors are different.

5. The backless and strapless winged bra according to claim 1, wherein the pair of cups further includes no underwire affixed below the pair of cups and between the wings.

6. The backless and strapless winged bra according to claim 1, wherein the pair of cups further includes a at least one underwire affixed below the pair of cups and between the wings.

7. The backless and strapless winged bra according to claim 1, wherein the adhesive layer of the pair of wings is a silicone based adhesive layer.

8. The backless and strapless winged bra according to claim 1, wherein the material of the protective layer is same as of the material of the outer and inner surfaces of said pair of cups.

9. The backless and strapless winged bra according to claim 4, Wherein the material of the protective layers corresponds in color to the colors of said first and second fabric layers, respectively.

10. The backless and strapless winged bra according to claim 1, wherein the protective layers comprise a first shape that corresponds to the pair of wings having a second shape.

11. A backless and strapless winged bra, the backless and strapless winged bra comprising:

a) a pair of cups having a color and a front and back side, with proximal and distal ends;

b) a pair of wings with a front surface and a back surface, wherein a first wing is attached to said distal end of a first cup and a second wing is attached to said distal end of the second cup;

c) an adhesive layer disposed on the first surface and the second surface of each wing for adhering the said wings to a torso of a wearer; and;

d) a protective layer placed on the adhesive layer, wherein the protective layer is detachable from the adhesive layer, and further wherein the protective layer has color that is the color of the said front and back sides of said pair of cups.

12. A backless and strapless winged bra according to claim 11; wherein at least one underwire is affixed below the pair of cups.

13. A backless and strapless winged bra according to claim 11, wherein the said bra is reversibly wearable.

14. A method for wearing a reversible winged bra having a pair of cups with distal ends, and comprising a wing member located at each distal end, said wing member having two surfaces with adhesive disposed thereon each surface, and said adhesive protected by a protective layer, the method comprising:

positioning each of the pair of cups on breasts of a user;

peeling off a protective layer on an inner surface of said wing members to be attached to a torso of a user thereby exposing said adhesive;

securing the reversible winged bra to the said torso of the user through the adhesive; and, retaining said protective layer on the opposed surface of the wing member not adhered to the said torso of the user.

* * * * *